US009153115B1

(12) United States Patent
Ulner

(10) Patent No.: US 9,153,115 B1
(45) Date of Patent: Oct. 6, 2015

(54) FALL IMPACT SIGNAL TRANSMITTER

(71) Applicant: Eric Ulner, Buncombe, IL (US)

(72) Inventor: Eric Ulner, Buncombe, IL (US)

( * ) Notice: Subject to any disclaimer, the term of this patent is extended or adjusted under 35 U.S.C. 154(b) by 9 days.

(21) Appl. No.: 14/226,985

(22) Filed: Mar. 27, 2014

Related U.S. Application Data

(60) Provisional application No. 61/806,233, filed on Mar. 28, 2013.

(51) Int. Cl.
*G08B 23/00* (2006.01)
*G08B 21/04* (2006.01)

(52) U.S. Cl.
CPC ..... *G08B 21/0446* (2013.01)

(58) Field of Classification Search
CPC .. A61B 5/1117; G08B 21/02; A62B 35/0018; A62B 35/0093; A62B 35/0043
USPC ..... 340/679, 573.1, 673, 685, 665, 668; 182/3, 18
See application file for complete search history.

(56) References Cited

U.S. PATENT DOCUMENTS

| | | | | |
|---|---|---|---|---|
| 6,487,812 | B2 | 12/2002 | Johnson | |
| 7,106,205 | B2 * | 9/2006 | Graef et al. | 340/573.1 |
| 7,201,619 | B1 | 4/2007 | Viggiano et al. | |
| 7,450,332 | B2 | 11/2008 | Pasolini et al. | |
| 7,463,148 | B2 | 12/2008 | Leen | |
| 2008/0060872 | A1 | 3/2008 | Wise | |
| 2010/0231402 | A1 * | 9/2010 | Flynt et al. | 340/679 |
| 2010/0282541 | A1 * | 11/2010 | Renton et al. | 182/234 |
| 2012/0101770 | A1 * | 4/2012 | Grabiner et al. | 702/141 |
| 2014/0008147 | A1 * | 1/2014 | Jones et al. | 182/3 |

FOREIGN PATENT DOCUMENTS

WO 2012158554 11/2012

* cited by examiner

*Primary Examiner* — Phung Nguyen
(74) *Attorney, Agent, or Firm* — Spencer Fane Britt & Browne LLP

(57) ABSTRACT

A fall impact signal transmitter device is associated with a fall arrest harness to provide an alert signal when a user has experienced a fall event and is suspended in the fall arrest harness. A transmitter is disposed within a housing and is caused to issue a distress signal when actuated by an engagement member when a fall event occurs. The transmitter may be Bluetooth® enabled to permit a distress signal to be communicated by the user's own cell phone, or to permit two-way communication through the cell phone between the user and a called number.

9 Claims, 6 Drawing Sheets

FALL IMPACT SIGNAL TRANSMITTER

RELATED APPLICATION

The present non-provisional patent application claims priority benefit of an earlier-filed provisional patent application of the same title, Ser. No. 61/806,233, filed Mar. 28, 2013. The identified earlier-filed application is hereby incorporated by reference into the present application.

BACKGROUND OF THE INVENTION

The present invention relates to apparatus for individuals conducting activities at elevated heights. In particular, the invention relates to safety devices addressing hazards that occur when an individual uses safety harnesses for preventing an individual from free-falling while conducting activities at an elevated height.

Many activities require an individual to work at an elevated height. A few examples of such activities include work on bridges, construction of high-rise buildings and office-building window-washing. Recreational activities also may involve an individual being positioned at an elevated height, such as hunting from a deer stand. In each of these activities, a safety harness is used to prevent the individual from free-falling to the ground. Generally, however, an individual who has partially fallen and been retained by the safety harness nevertheless is likely to remain suspended and not automatically brought to a secure position. That is, the individual generally remains dangling until assistance arrives to bring the individual into a fully controlled position such that the individual is freed from the harness and is able to move around on his own. Frequently, the individual is alone at the activity site, especially in the hunting environment, and assistance after a fall may be delayed until somebody else actually is made aware that the individual has fallen.

Being in a suspended position while in a harness for any length of time is extremely dangerous because it severely impacts the ability of the body's circulatory system to function effectively. The straps of the harness are placed under considerable tension from the weight of the person's body causing the straps to cut off circulation and blood flow. The restriction of blood to the body's upper organs, such as the heart and brain, leads to disastrous consequences. This adverse medical phenomenon associated with being suspended in a safety harness is well-known and documented. The condition is known as suspension trauma (or harness induced pathology) and is addressed by the Occupational Safety & Health Administration (OSHA) of the U.S. Department of Labor. See http://osha.gov/dts/shib/shib032404.html.

Accordingly, there is a need for a safety device for use with a fall arrest harness that can provide an alert when an individual experiences a fall event while in the harness. It is further desirable that the safety device be capable of issuing a distress signal that can be sent to an appropriate recipient, such as an emergency responder, such that help can be summoned to assist the individual in being freed from the suspended state. It is further desirable that the safety device's distress signal be compatible with a telecommunication device, such as a cell phone, such that vocal communication can occur between the individual experiencing the fall event and the emergency responder.

SUMMARY OF THE INVENTION

The present invention comprises a fall impact signal device for use by a person wearing a fall arrest harness. The signal device is rigged on the user in an arrangement such that the fall will actuate an alarm or signal indicating that the individual has fallen. The signal therefore communicates that the person is confined in the safety harness in a suspended state and is in need of emergency assistance. The safety device can be connected either directly to the anchor support to which the safety harness is tethered, or may be connected to or integrated within the safety harness itself. In either event, a fall event will cause the alarm or signal on the signal device to be actuated.

One embodiment of the signal device comprises a housing for receiving a transmitter. The transmitter is equipped with a switch member that actuates the transmitter to emit a signal. The fall event triggers the switch member in the transmitter causing the alarm signal to be issued. An engagement member is received within the housing and engages the transmitter switch member. The engagement member may be a continuation of the strap that connects the signal device to the anchor support or safety harness. Under pressure from a fall event, the strap tightens and forces against the transmitter switch member to actuate the alarm signal. The alarm signal may comprise one or more types of alarms, including visual distress signals such as flashing lights and audible signals such as a siren sound.

In accordance with a further aspect of the invention, the transmitter is adapted with Bluetooth® technology whereby the alarm signal may comprise a command to a designated cell phone to place a predetermined emergency call.

In accordance with yet another aspect of the invention, the transmitter is a two way radio permitting vocal communication between the transmitter and a remote receiver.

These and other features, aspects and advantages of the present teachings will become better understood with reference to the following description.

DRAWINGS

Those of skill in the art will understand that the drawings, described below, are for illustrative purposes only. The drawings are not intended to limit the scope of the present teachings in any way.

DETAILED DESCRIPTION

Figure 1:
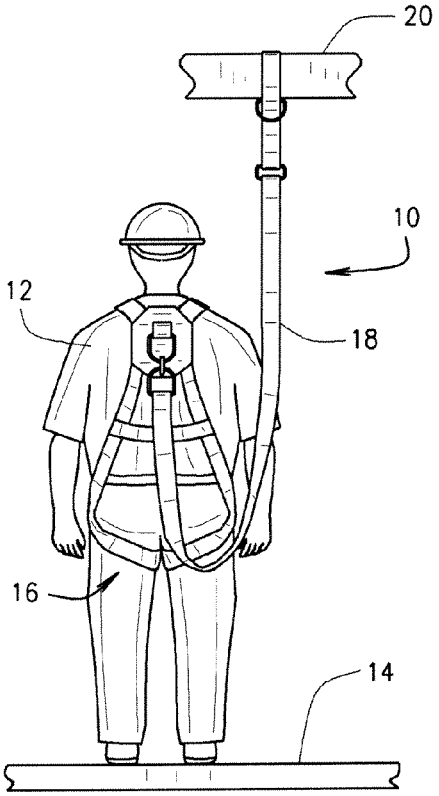
FIG. 1 is a pictorial view of a person wearing a fall arrest harness.

A fall arrest system 10 is generally shown in FIG. 1. It is used by a person 12 that performs activity at an elevated height such as on scaffold 14. A fall arrest system 10 generally comprises a harness 16 worn by person 12 and is tethered by tether line 18 to an anchor support, such as beam 20. FIG. 1 shows the harness and tether line connected in a "dorsal" attachment towards the back middle-shoulder area of the user. Other attachment arrangements can be such that the connection is at the front chest area of the user. The at-height environment can be any in which a person works at an elevated height.

Figure 2:
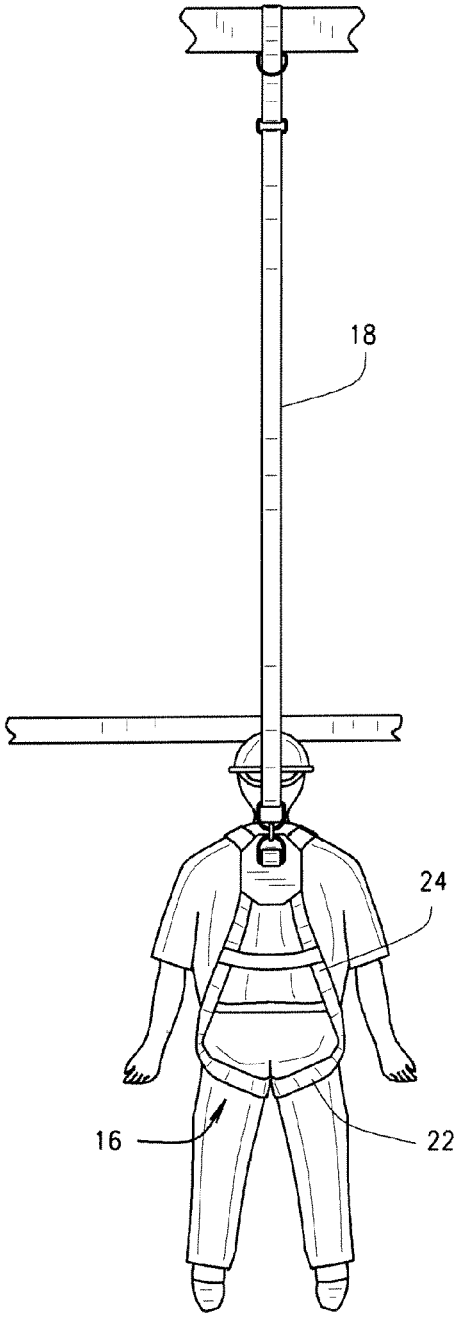
FIG. 2 is a pictorial view of a person suspended in a fall arrest harness after a fall event.

If a person wearing a fall arrest system falls while working at height (a "fall event"), the harness 16 and tether line 18 operate to prevent the user from falling catastrophically to the ground. Some fall arrest systems are designed to slow the rate of fall so that the user does not suffer from the sudden impact upon reaching the end of the tether line. Generally, however, the fall arrest system is limited to preventing the catastrophic fall to the ground, and is not designed to bring the user to complete safety on the ground or to a surface upon which the user may regain standing control. Accordingly, a user will still remain suspended in harness 16 above the ground as shown in FIG. 2. As the user remains suspended, his own body weight will place substantial pressure against leg straps 22 and upper body straps 24. This will cause the straps to press tightly against the user's critical arteries and veins in the leg and thoracic regions, effectively restricting the flow of blood to the user's upper organs, including the heart and brain. The restriction of the user's circulatory system will ultimately lead to suspension trauma and place the user in an extremely hazardous health situation.

The invention provides a system for emitting a distress signal upon the occurrence of a fall event experienced by a person wearing a fall arrest system. An embodiment of the invention comprises a housing 26 in which a transmitter 28 is positioned. For purposes of explanation in this particular embodiment, transmitter 28 may be a wireless Bluetooth® enabled device capable of being paired with a cell phone (not shown). An example of such a device is manufactured by the Zomm company and sold under the trademark Wireless Leash™ (www.zomm.com). This type of device provides features including a panic alarm, 911 access, and a speakerphone. Transmitter 28 is provided with a push button 34 that actuates the alarm and other transmission features when depressed. In the exploded view of FIG. 4, housing 26 comprises a base element 30 and a cover member 32. Base element 30 is provided with a compartment 36 for receiving transmitter 28. Cover member 32 engages base element 30 to enclose transmitter 28 in housing 26. Passageway 38 is configured into cover member 32 to provide a channel for strap 40 which lies adjacent to push button 34 of transmitter 28 when the housing is assembled.

Figure 3:
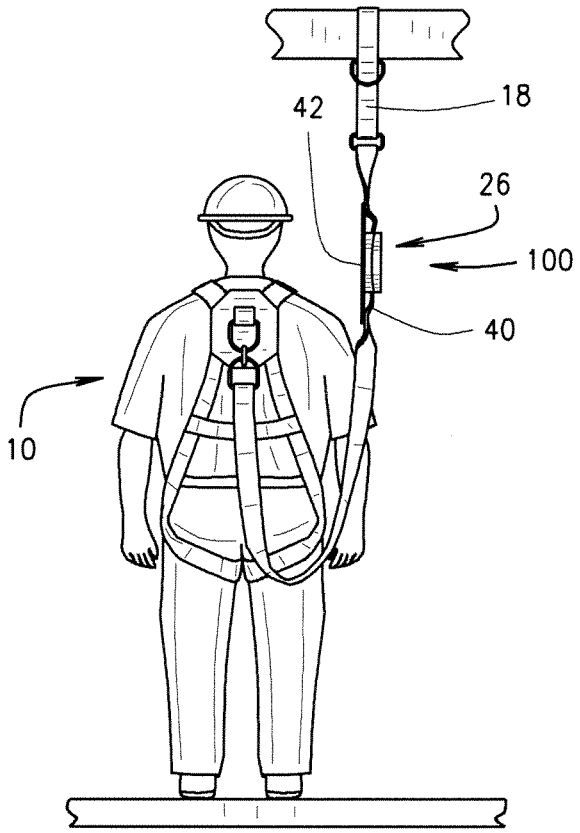
FIG. 3 is a pictorial view of a person wearing a fall arrest harness with the fall signal device of the present invention integrated into the fall arrest strap.
Figure 5:
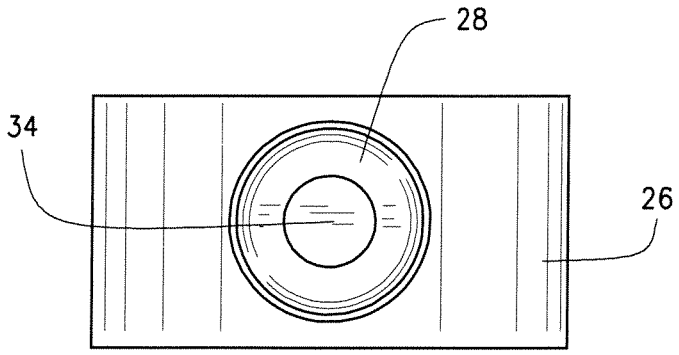
FIG. 5 is a top plan cross-sectional view of the interior of the fall signal device housing of FIG. 4.
Figure 8:
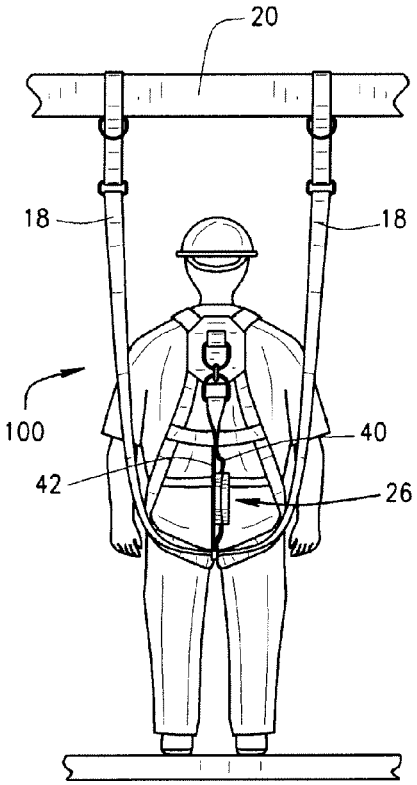
FIG. 8 is a pictorial view of person wearing the fall signal device as a separate attachment from the fall arrest harness.
Figure 9:
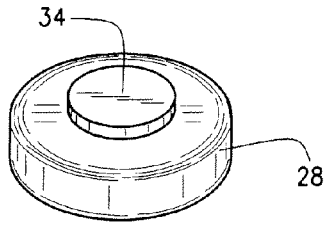
FIG. 9 is a perspective view of the transmitter device.

The arrangement of the housing 26 and strap 40 are part of the overall fall impact signal transmitter device 100 shown deployed in FIG. 3. In this arrangement strap 40 is connected in serial fashion with the tether strap 18 of fall arrest system 10. That is, housing 26 is connected to tether line 18 by strap 40 which is placed in an intermediate position along tether line 18. Strap 40 and tether line 18 may be connected by conventional means such as D-rings. In this connection, the force of a fall event is transmitted to housing 26. Alternatively, fall impact signal transmitter device 100 may also be used in connection with a Y-lanyard tether line as shown in FIG. 8. In this arrangement, however, the fall impact signal transmitter 100 must be placed at the trunk portion of the Y-lanyard tether line so as not to disrupt the fall arrest features of the harness.

Figure 6:
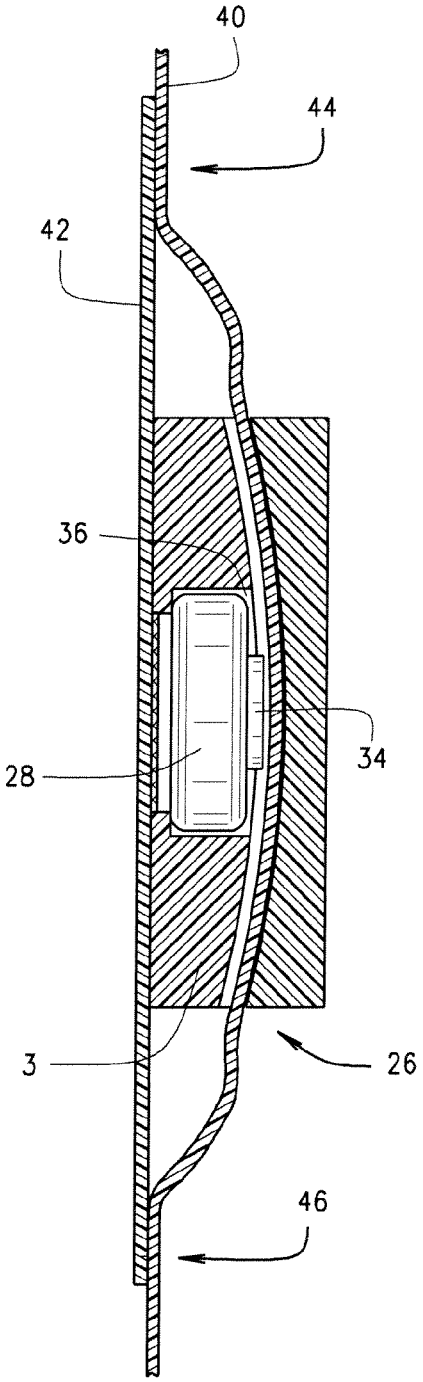
FIG. 6 is a cross sectional view in side elevation of the housing with the transmitter in recess with the engagement strap in un-tightened state engaging against the transmitter button.
Figure 7:
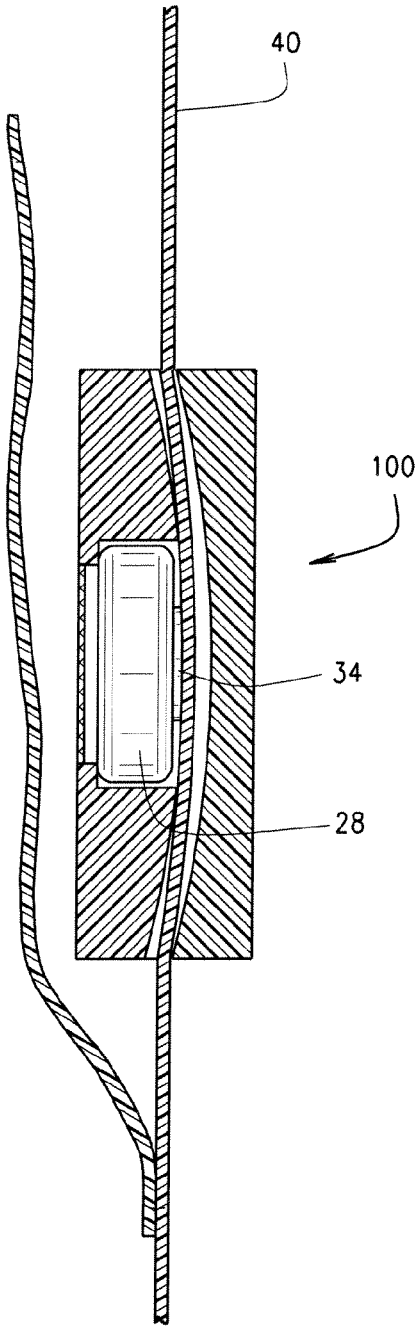
FIG. 7 is a cross sectional view in side elevation of the housing with the transmitter in recess with the engagement strap in a tightened state engaging and depressing the transmitter button.

As shown in FIGS. 6 and 7, strap 40 is adapted to engage and depress push button 34 upon the occurrence of a fall event to trigger the distress signal or other alarm feature of transmitter 28. FIG. 6 shows the arrangement when the fall impact signal transmitter device 100 is at rest, that is, at all times other than after the occurrence of a fall event. The compartment 36 of base element 30 of housing 26 provides a depth such that the push button 34 of transmitter 28 lies substantially above the plane of the opening of compartment 36. Strap 40 passes through housing 26 and lies adjacent to push button 34. That portion of strap 40 that passes through housing 26 is placed under a slight slack by using auxiliary strap 42 is secured to strap 40 at points 44 and 46 with the slack of strap 40 placed between points 44 and 46. Under normal use conditions, strap 40 and auxiliary strap 42 provide the line of connection of fall impact signal transmitter device 100 to the fall arrest harness (for a serial attachment as shown in FIG. 3) or the anchor point (for a parallel attachment as shown in FIG. 8) and no tension is placed on that portion of strap 40 between points 44 and 46 and passing through housing 26. Points 44 and 46 are stitched together using seams that will break away when subjected to an impact force approximating that experienced when a person's fall is abruptly stopped by the safety harness during a fall event. When a fall event occurs, the force placed on strap 40 will cause it to be immediately tightened to eliminate the slack shown in FIG. 6. The stitchings at either, or both of, points 44 and 46 will be broken by the force causing strap 40 to tighten along its length within housing 26 as shown in FIG. 7. The tightening of strap 40 within housing 26 causes it to engage and depress push button 34 of transmitter 28 to actuate the alert signal. The stitching at points 44 and 46, however, must be resistant to breakage when exposed to forces less than two (2) kilo-newtons to avoid inadvertent triggering of the transmitter when a user does not experience a fall event but merely leans into the harness gear, which can itself place substantial force on strap 40. In an alternate embodiment, auxiliary strap 42 may be omitted if the push button 34 of transmitter 28 is itself resistant to depressive forces less than that experienced in the impact of a fall event. That is, strap 40 may actively engage push button 34 in housing 26, but push button 34 will only be depressed if it is subjected to a force at least as great as that experienced in a fall event.

Figure 4:
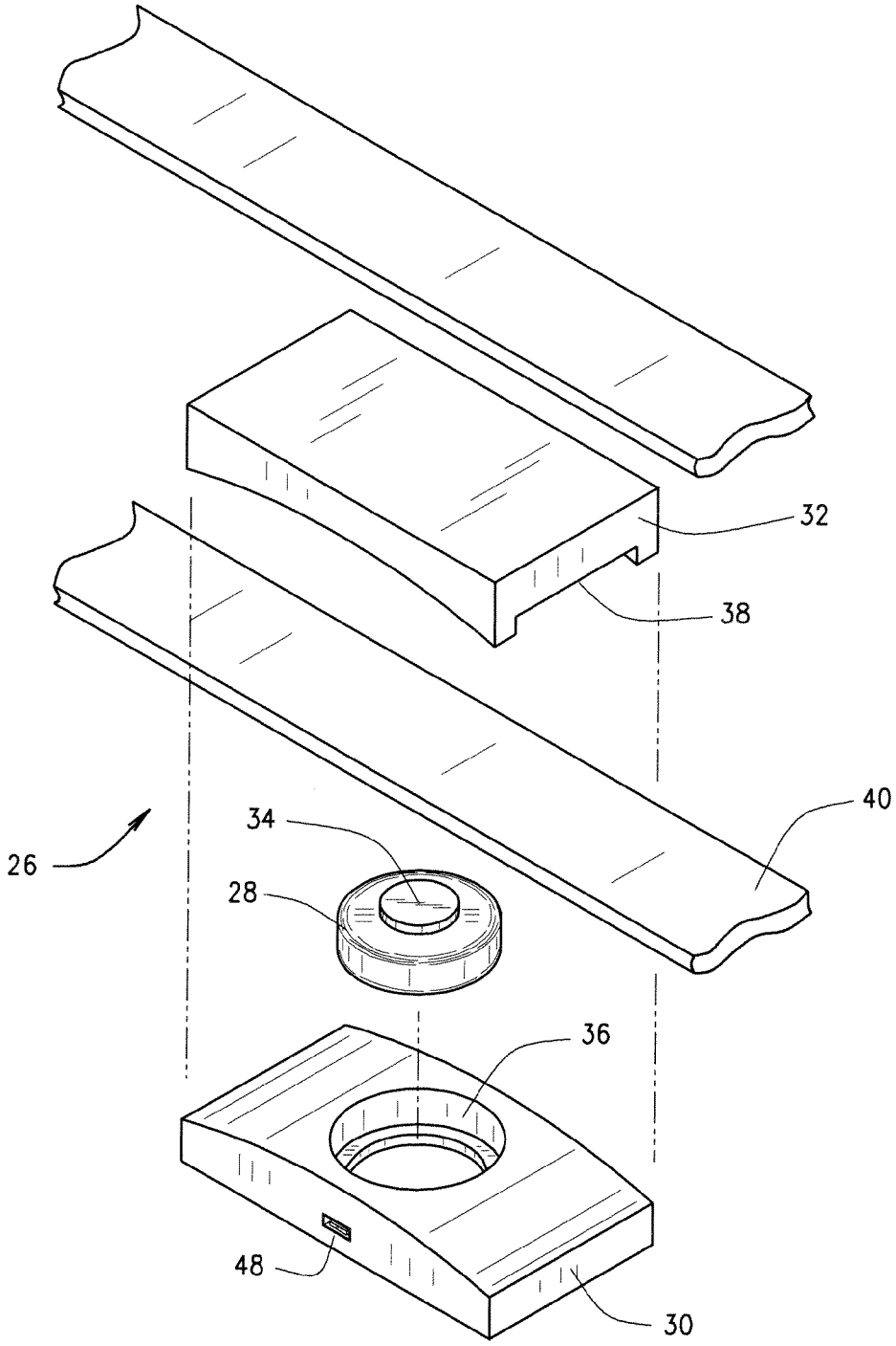
FIG. 4 is an exploded view of the housing for an embodiment of the fall signal device.
Figure 10:
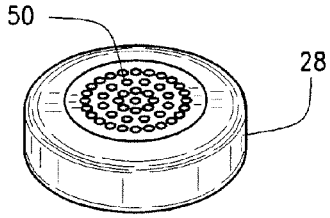
FIG. 10 is a perspective view showing the opposite side of the transmitter device.
Figure 11:
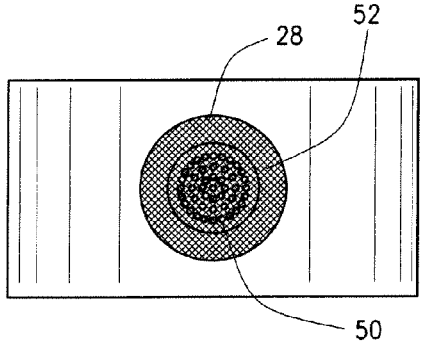
FIG. 11 is a bottom plan view of the fall signal device housing.

Transmitter 28 may have a speaker 50 on its reverse side as shown in FIG. 10. Speaker 50 may be provided with multiple functions, such as emitting an audible signal in the nature of an alarm, or serving as a speaker for two-way transmission between the user and a remote party. Housing 26 may be provided with a screen barrier 52 at the bottom of compartment 36 to permit the audible signal of transmitter 28 to emit from the housing. The housing may be provided with a USB port 48 as shown in FIG. 4 for enabling the transmitter to be accessed and/or programmed while in the housing. The USB port could be provided with a rubber seal to prevent moisture from entering the housing and transmitter.

Figure 12:
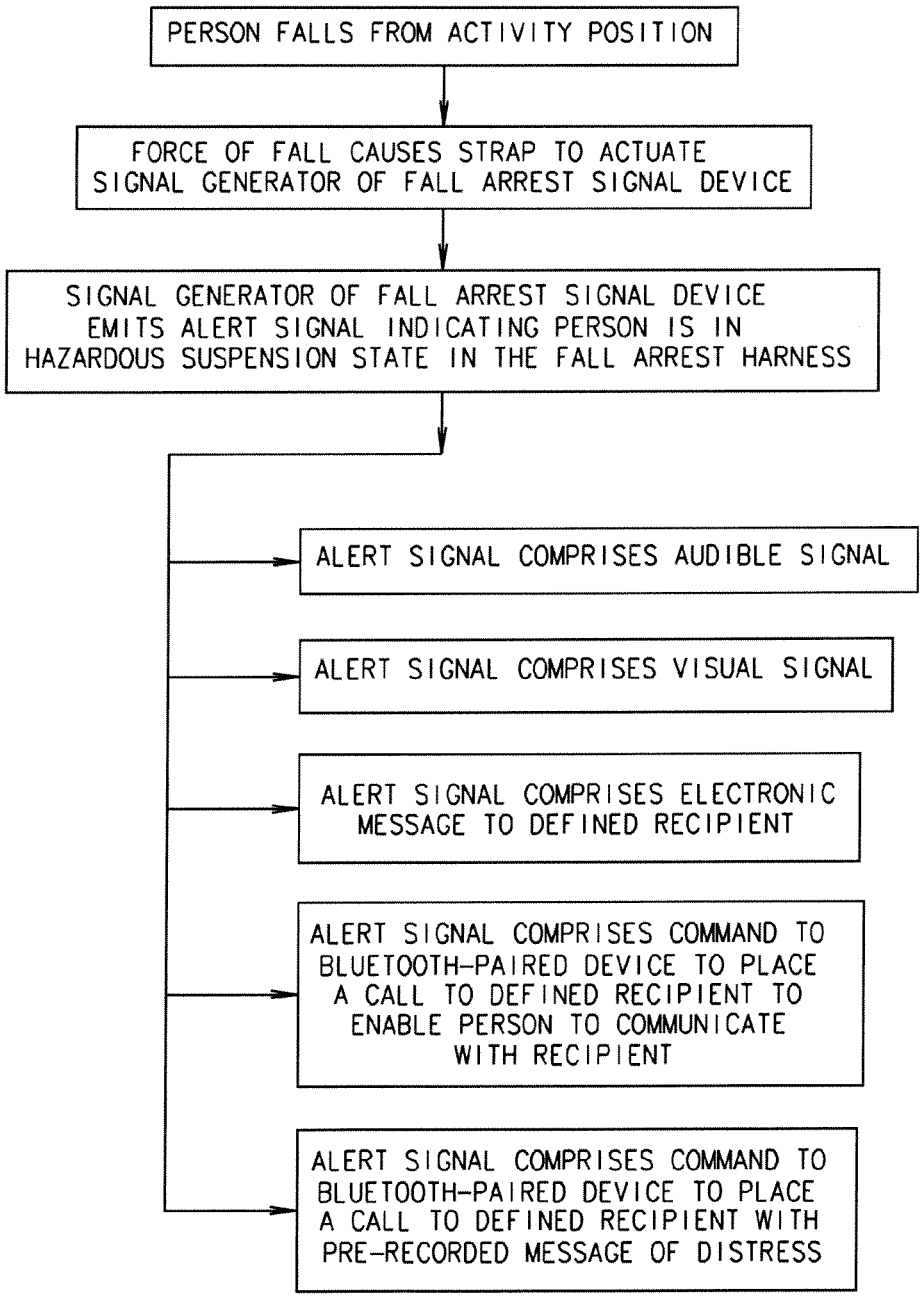
FIG. 12 is a flowchart of events in which the fall signal device is deployed during a fall event.

The employment of the fall impact signal transmitter of the present invention is set forth in the flowchart of FIG. 12. Fall impact signal transmitter device 100 is rigged in an arrangement such as in FIG. 3 where it is integrated into the straps of the tether line 18 for the fall arrest harness. The placement of the signal transmitter device can depend of the particular transmission signals that the transmitter is capable of sending.

If the transmission signals are limited to visual alerts, such as flashing lights, or a simple audible distress signal, then the housing for the signal transmitter device need not be in close proximity to the user while he is suspended. If the signal transmitter device is capable of providing two-way communication, then the signal transmitter device should be placed so that it would be within reach of the user as he is suspended. The present invention may embody any of multiple distress signal types, and the transmitter may be of a type that can accommodate one or more distress signal types. Low cost alternatives can employ very simple distress signals such as flashing lights or audible sounds, such as a siren. More advanced features can include transmissions that send an electronic signal to a predetermined receiver, such as to a supervisor's pager or device capable of receiving a text message. Bluetooth® technology can permit a pairing of the transmitter device with one's own cell phone so that the user's cell phone can be triggered to place a call either to a predetermined number, such as 911, or to enable a two-way conversation. The transmitter may also be equipped with GPS whereby the person's position may be determined if he becomes unconscious and is not able to communicate his location. This feature would be beneficial in the hunting context where the hunter's spot is not known beforehand.

In another embodiment, the housing for the fall impact signal transmitter may be integrated into a seat belt of a motor vehicle. The seat belt could pass through the housing and be engageable with the transmitter button as discussed above. The push button of the transmitter would be made to be resistant to depressive forces less than that experienced in the impact of a crash, but greater than forces that would be experienced by normal movement of the seat occupant. That is, the push button would not be actuated by the person merely leaning to one side, or by normal traffic occurrences such as slamming on the brakes. Accordingly, the push button would be made resistant to depressive forces less than two (2) kilonewtons. The resistance built in to the push button could be made to vary depending upon the weight of the seat occupant.

The detailed description set-forth above is provided to aid those skilled in the art in practicing the present invention. However, the invention described herein is not to be limited in scope by the specific embodiments herein disclosed because these embodiments are intended as illustration of several aspects of the invention. Any equivalent embodiments are intended to be within the scope of this invention. Indeed, various modifications of the invention in addition to those shown and described herein will become apparent to those skilled in the art from the foregoing description which do not depart from the spirit or scope of the present inventive discovery.

The invention claimed is:

1. An apparatus for effecting a signal upon an event comprising a fall of a person while wearing a fall arrest harness connected by a line member to a support, the apparatus comprising:

a housing, a signal transmitter, and an arrest engagement member, the signal transmitter being contained within the housing, the signal transmitter having an actuator member for effecting a signal generated by the signal transmitter, the arrest engagement member being placed within the housing, the signal transmitter being positioned in the housing such that the arrest engagement member is operably engageable with the actuator member within the housing, the housing connecting to the line member, the arrest engagement member being adapted to transmit a force generated by a tightening of the line member upon the event comprising the fall of a person wearing the fall arrest harness, whereby upon a fall arrest the arrest engagement member is forced against the actuator member of the signal transmitter to generate a signal.

2. An apparatus for effecting a signal upon an event comprising a fall of a person while wearing a fall arrest harness connected by a line member to a support, the apparatus comprising:

a housing, an auxiliary line member, and a signal transmitter, the signal transmitter being contained within the housing, the signal transmitter having an actuator member for effecting a signal generated by the signal transmitter, the housing having a passageway for receiving the line member therethough, the signal transmitter being positioned in the housing such that the line member passing through the housing is engageable with the actuator member, the auxiliary line member being engageable with the line member at points along the line member towards its entry into and exit from the housing to create a slack in the line member passing through the housing between the points of engagement with the auxiliary line member, the points of engagement of the auxiliary line member with the line member being breakable upon tension being placed on the line caused by a fall event, whereby upon a fall arrest the line member passing through the housing is forced by tension against the actuator member of the signal transmitter to generate a signal.

3. The apparatus of claim 2 in which the breakable points of engagement of the auxiliary line member to the line member comprises stitching that is resistant to breakage at forces less than two kilo-newtons.

4. The apparatus of claim 2 in which the housing comprises a base element and a cover member, the base element having a compartment for receiving the signal transmitter such that the actuator member of the signal transmitter lies outside of the opening of the compartment, the cover member defining an internal channel for receiving the line to lie adjacently to the actuator member of the signal transmitter when the cover member is connected to the base member.

5. The apparatus of claim 2 in which the signal generated is an audible sound.

6. The apparatus of claim 2 in which the signal generated is a visual signal.

7. The apparatus of claim 2 in which the signal generated comprises an electronic message delivered to a defined recipient.

8. The apparatus of claim 2 in which the signal generated comprises a voice-generated communication to a defined recipient.

9. The apparatus of claim 2 in which the signal generated comprises a pre-recorded message for delivery to a defined recipient.

* * * * *